US006089904A

United States Patent [19]

Wu

[11] Patent Number: 6,089,904

[45] Date of Patent: Jul. 18, 2000

[54] FFC CONNECTOR

[75] Inventor: Jerry Wu, Chang-Hua, Taiwan

[73] Assignee: Hon Hai Precision Ind. Co., Ltd., Taipei Hsien, Taiwan

[21] Appl. No.: 09/293,445

[22] Filed: Apr. 16, 1999

[51] Int. Cl.[7] ..... H01R 12/24

[52] U.S. Cl. ..... 439/495; 439/62

[58] Field of Search ..... 439/495, 496, 439/78, 62

[56] References Cited

U.S. PATENT DOCUMENTS

| | | | |
|---|---|---|---|
| 3,887,255 | 6/1975 | Codrino | 439/496 |
| 4,479,686 | 10/1984 | Hoshino et al. | 439/78 |
| 4,575,167 | 3/1986 | Minter | 439/83 |
| 5,611,699 | 3/1997 | Tanigawa | 439/78 |
| 5,658,164 | 8/1997 | Parker | 439/495 |
| 5,658,165 | 8/1997 | Yokota | 439/495 |
| 5,688,143 | 11/1997 | McHugh et al. | 439/495 |
| 5,904,589 | 5/1999 | Asakawa | 439/495 |
| 5,921,785 | 7/1999 | Li | 439/60 |
| 5,928,029 | 7/1999 | Lam | 439/497 |
| 5,934,932 | 8/1999 | Ito | 439/495 |

FOREIGN PATENT DOCUMENTS 0280450 8/1988 European Pat. Off. .

OTHER PUBLICATIONS

Haynes, J. L., Horseshoe Printed Circuit Board Edge Connector, IBM Technical Disclosure Bulletin, vol. 27 No. 5, pp. 2941–2942, Oct. 1984.

*Primary Examiner*—Neil Abrams
*Assistant Examiner*—Hae Moon Hyeon
*Attorney, Agent, or Firm*—Wei Te Chung

[57] ABSTRACT

A FFC connector comprises a dielectric housing having top and bottom faces. The top face defines an elongate slot extending into the housing and the bottom face defining an entrance in communication with the elongate slot for insertion of a FFC cable. A plurality of terminal cells is defined in the housing and each terminal cell being in communication with the elongate slot. A plurality of terminals is assembled in the terminal cells and each terminal includes a base portion received in the housing and a spring arm extending from the terminal cell into the elongate slot. The terminal further forms a soldering tail for mounting to a printed circuit board.

10 Claims, 7 Drawing Sheets

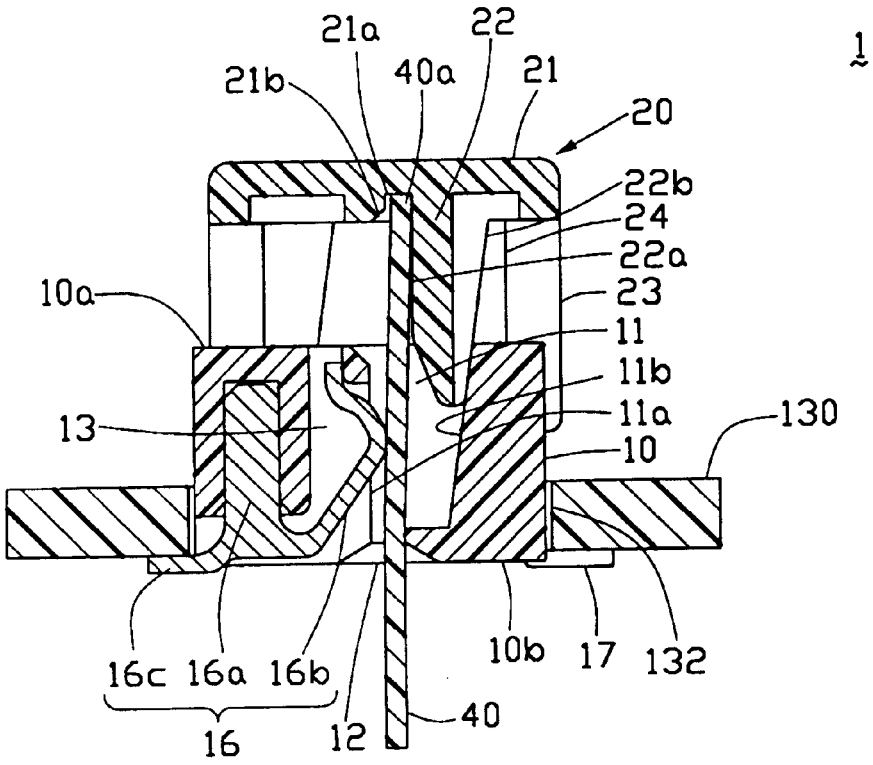
FIG. 10
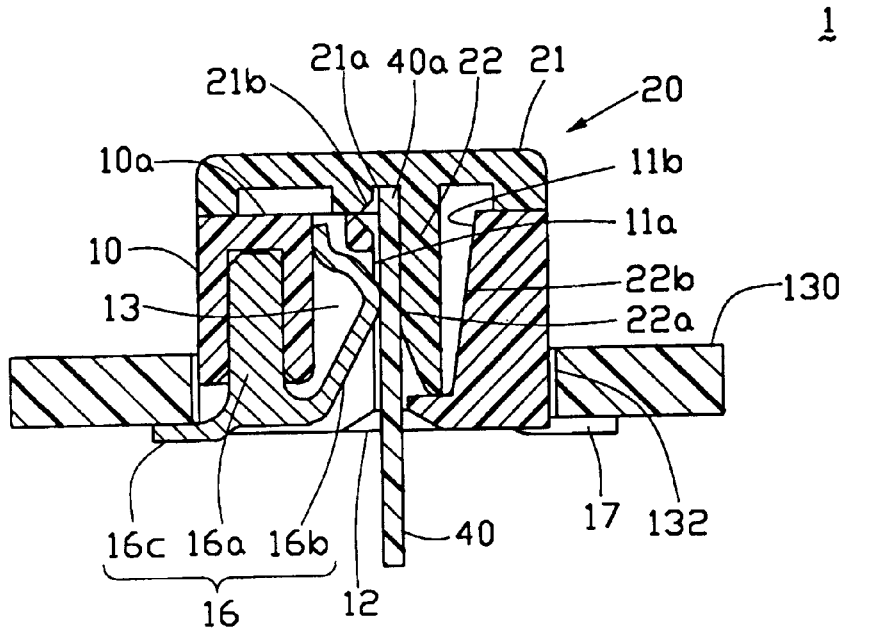
FI.G 11

FFC CONNECTOR

FIELD OF THE INVENTION

The present invention relates to a flat flexible cable (FFC) connector, and more particularly to an FFC connector having a bottom entry for facilitating easy insertion of an FFC cable from a bottom direction.

DESCRIPTION OF THE PRIOR ART

Conventionally, an FFC connector includes a housing with a plurality of terminals assembled therein. The housing further defines an elongate slot for insertion of an FFC cable. Each terminal includes a spring arms extending into the elongate slot such that conductors of the FFC cable abut against to those spring arms thereby making electrical connection therebetween. However, deformation of the springs arms need a great deal of force thereby rendering difficult insertion of the FFC cable.

In order to provide an easy insertion of the FFC cable, an actuator is introduced to a FFC connector to facilitate electrical connections between conductors of the cable and terminals within the connector. In this arrangement, the terminals within the FFC connector will not block the path of the FFC cable during insertion of the FFC cable, i.e. zero insertion force. When the FFC cable is fully inserted, the actuator is then moved such that the conductors of the inserted FFC contact with the terminals of the FFC connector.

In general, insertion direction of the FFC cable is parallel to the terminals, but in some application, the FFC cable comes from a bottom direction. For example, a hard disk drive includes a frame which encapsulates metal disks storing a great deal of data. Signal communication between inside and outside of the frame is facilitated by the FFC cable extending through a slit in the frame and then terminated to the FFC connector mounted on an outer face of the frame. Not only will this increase the length of the FFC cable, but will also complicate the assembly.

SUMMARY OF THE INVENTION

It is an objective of this invention to provide an FFC connector wherein an FFC cable is inserted thereto from a bottom entry.

In order to achieve the objective set forth, an FFC connector comprises a dielectric housing having top and bottom faces. The top face defines an elongate slot extending into the housing and the bottom face defining an entrance in communication with the elongate slot for insertion of an FFC cable. A plurality of terminal cells is defined in the housing and each terminal cell being in communication with the elongate slot. A plurality of terminals is assembled in the terminal cells and each terminal includes a base portion received in the housing and a spring arm extending from the terminal cell into the elongate slot. The terminal further forms a soldering tail for mounting to a printed circuit board.

These and additional objects, features, and advantages of the present invention will become apparent after reading the following detailed description of the preferred embodiments of the invention taken in conjunction with the appended drawings.

BRIEF DESCRIPTION OF THE DRAWINGS

FIG. 10 is similar to FIG. 8 with the FFC connector mounted in a recess of a substrate;

FIG. 11 is similar to FIG. 10 with an inserted FFC cable reaching to a final position;

DETAILED DESCRIPTION OF PREFERRED EMBODIMENT

Figure 1:
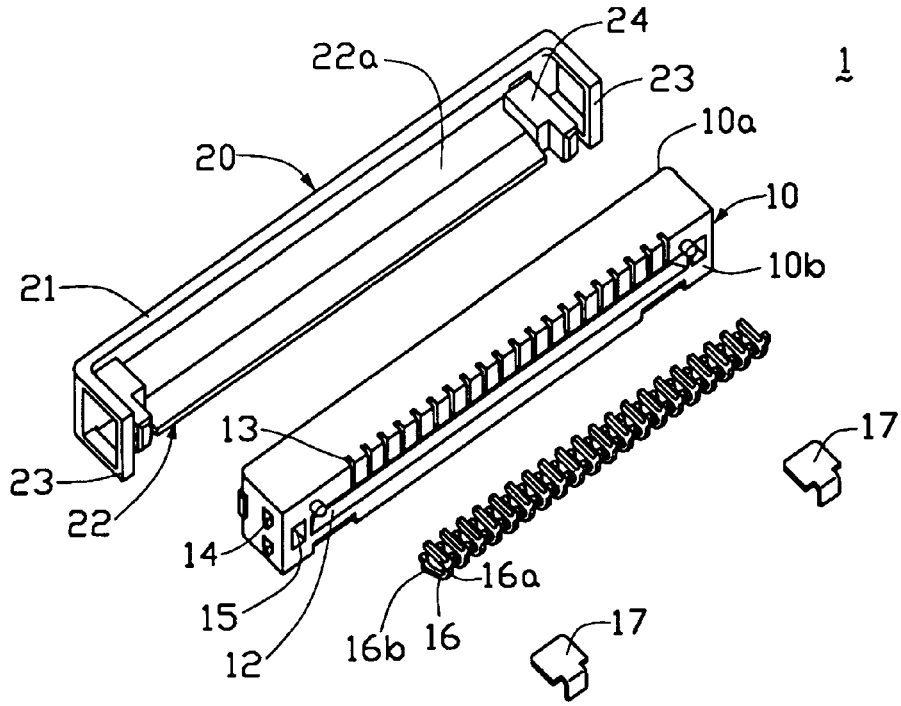
FIG. 1 is a perspective view of an FFC connector in accordance with the present invention.
Figure 2:
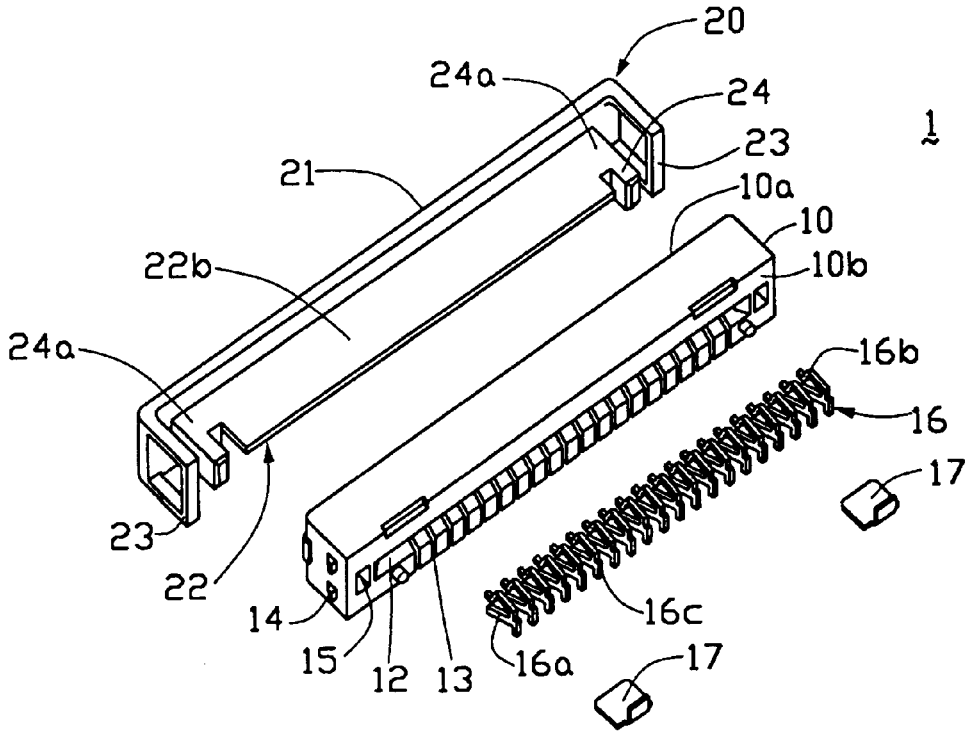
FIG. 2 is a perspective view of FIG. 1 viewed from a reverse angle.
Figure 3:
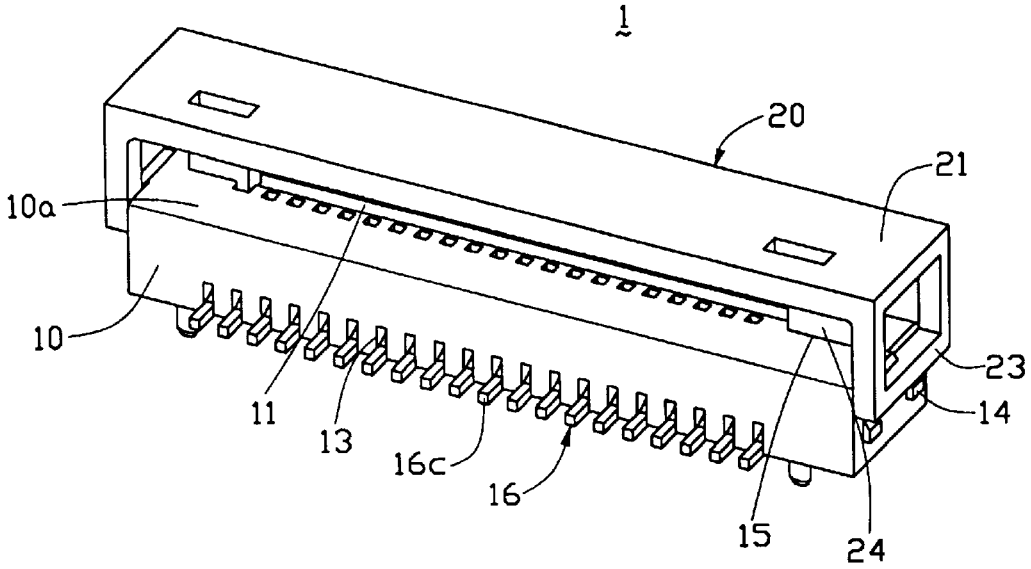
FIG. 3 is an assembled view of FIG. 1 with an actuator located at a first position.
Figure 4:
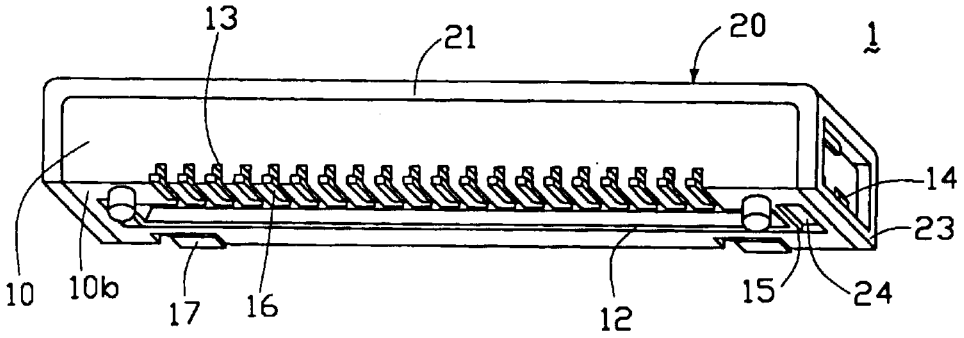
FIG. 4 is an assembled view of FIG. 1 with the actuator moved to a second position.
Figure 5:
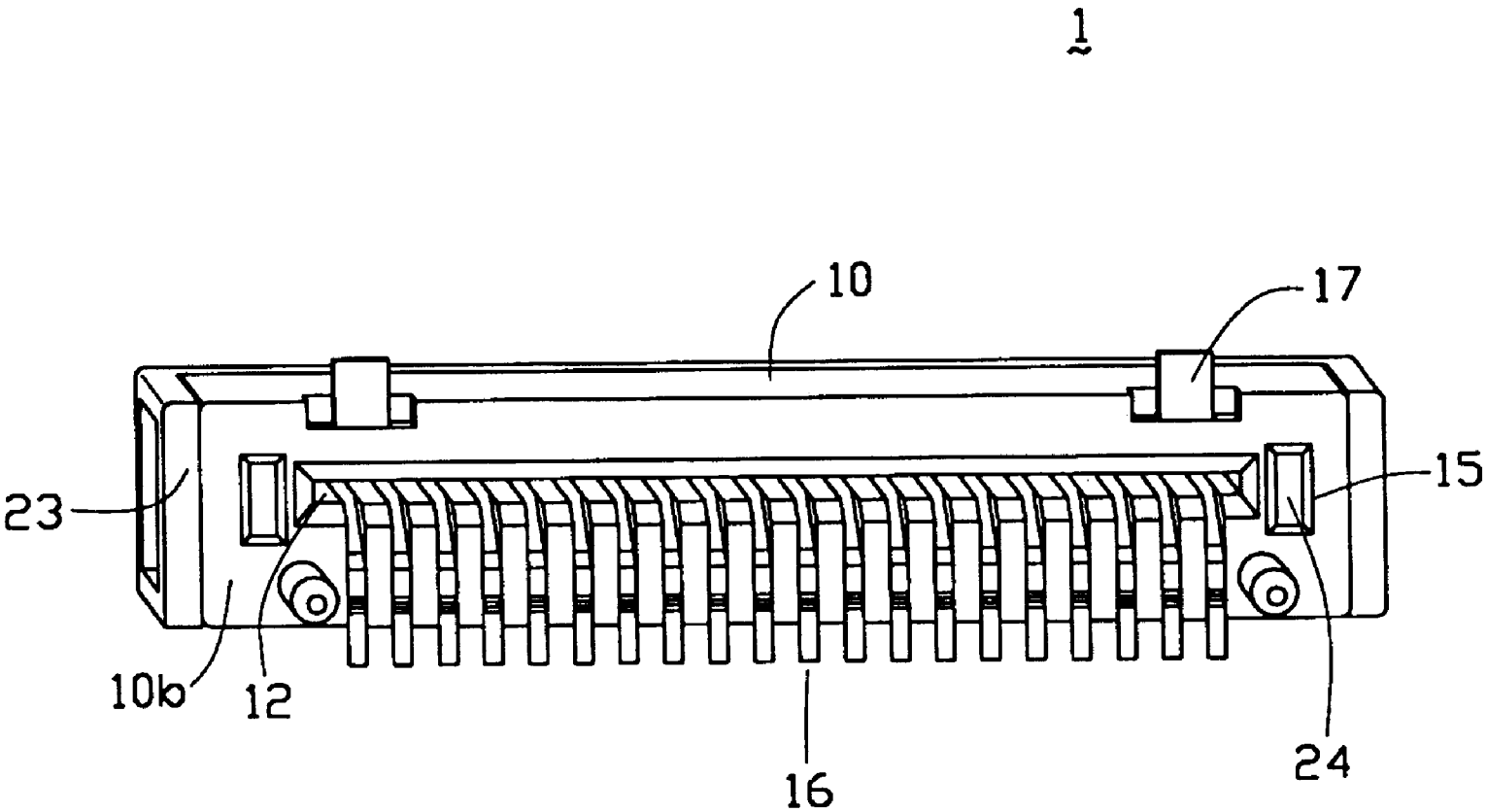
FIG. 5 is a perspective view taken from a bottom direction.

Referring to FIGS. 1, 2, 3, 4, 5, 6 and 7, an FFC connector 1 in accordance with the present invention comprises a dielectric housing 10 having top and bottom faces 10*a*, 10*b*. The top face 10*a* forms an elongate slot 11 extending into the housing 10 and the bottom face 10*b* forms a bottom entrance 12 in communication with the elongate slot 11 for insertion of a FFC cable 40. A plurality of terminal cells 13 is defined in the housing 10 and each terminal cell 13 is in communication with the elongate slot 11. The elongate slot 11 has a first surface 11*a* for supporting the inserted FFC cable 40 and a second surface 11*b* inclined with respect to the first surface 11*a*. The housing 10 further forms retaining wedges 14 at opposite ends thereof. The housing 10 further defines two guiding recesses 15 adjacent end walls thereof. The recess 15 includes an inclined surface (not labeled). A pair of ground pads 17 is assembled to the housing 10.

Figure 8:
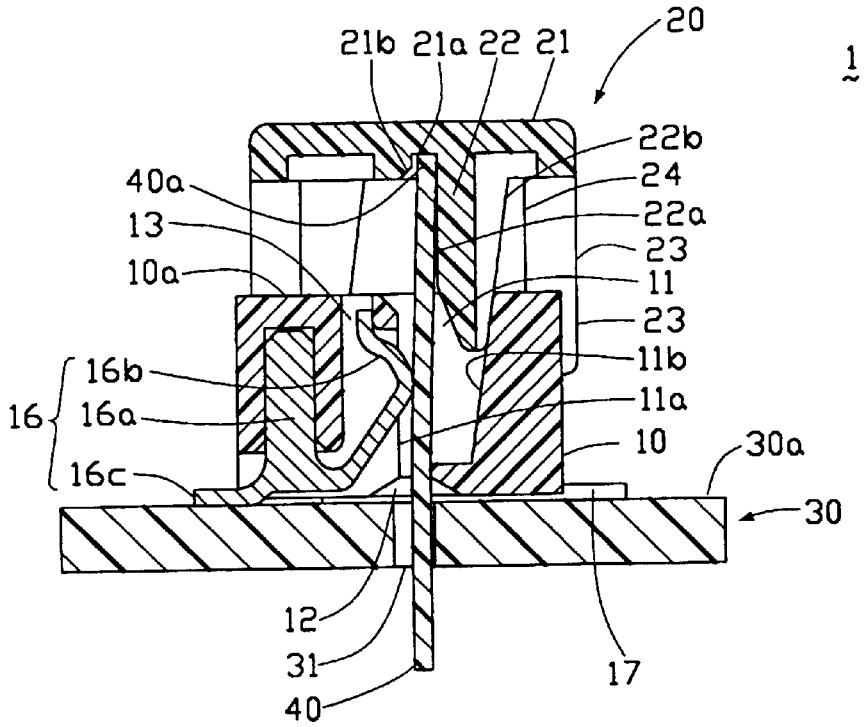
FIG. 8 is cross sectional view with an inserted FFC cable abutting against a bottom face of the actuator.

A plurality of terminals 16 is assembled in the terminal cells 13. Each terminal 16 includes a base portion 16*a* received in the housing 10 and a spring arm 16*b* extending from the terminal cell 13 into the elongate slot 11. The terminal 16 further forms a soldering tail 16*c* for mounting to a frame or printed circuit board 30 (FIG. 8).

An actuator 20 is assembled to the housing 10 for facilitating electrical connections between the inserted FFC cable 40 and the terminals 16. The actuator 20 includes a cover 21 assembled to the top face 10*a* of the housing 10 thereby sealing the elongate slot 11 of the housing 10. The cover 21 includes a tongue 22 extending into the elongate slot 11 for urging the FFC cable 40 against the first surface 11*a* of the elongate slot 11 in which the spring arms 16*b* extending therethrough. By this arrangement, electrical connections between the inserted FFC cable 40 and the terminals 16 are achieved. The tongue 22 includes a flat surface 22*a* for pressing against the inserted FFC cable 40 and an inclined surface 22*b* with respect to the flat surface 11*b*.

The cover 21 forms a retaining slot 21*a* at a bottom face thereof for receiving a portion of the inserted FFC cable 40. The retaining slot 21*a* further includes a leading edge 21*b* facilitating easy insertion of the FFC cable 40. The cover 21 includes a pair of retaining lugs 23 on opposite ends thereof for engaging with retaining wedges 14 formed on the housing 10. A pair of guiding posts 24 extends downward from the cover 21 corresponding to the guiding recesses 15 of the housing. The guiding post 24 includes an inclined face 24*a* flushed to the inclined surface 22*b*. By this arrangement, downward movement of the actuator 20 is accurately guided.

Figure 6:
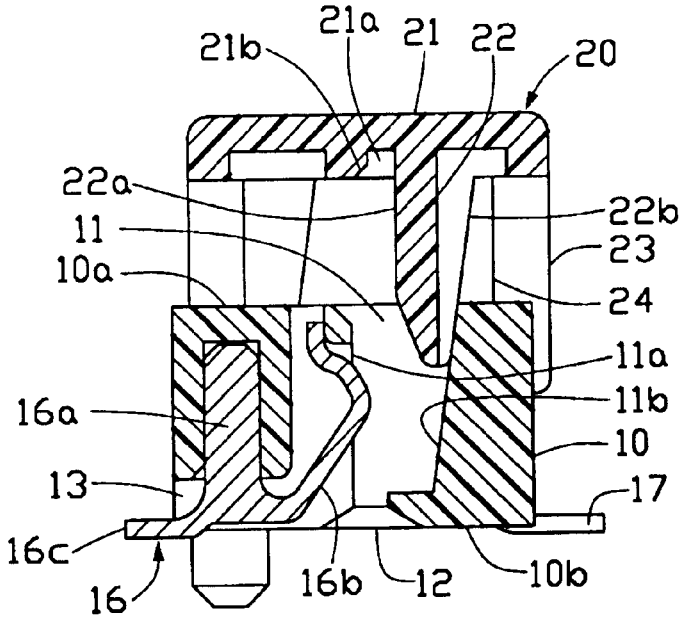
FIG. 6 is a cross sectional view taken along line VI—VI of FIG. 3.
Figure 7:
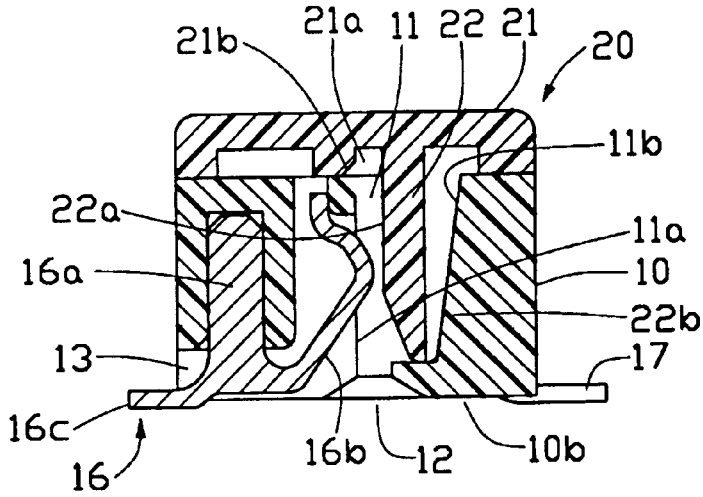
FIG. 7 is a cross sectional view taken along line VII—VII of FIG. 4.

Referring to FIG. 6 shows a cross sectional view with the actuator 20 located in a first position, while in FIG. 7 the actuator 20 reaches to a second position in which the elongate slot 11 formed in the upper face 10*a* is completely sealed by the actuator 20.

Figure 9:
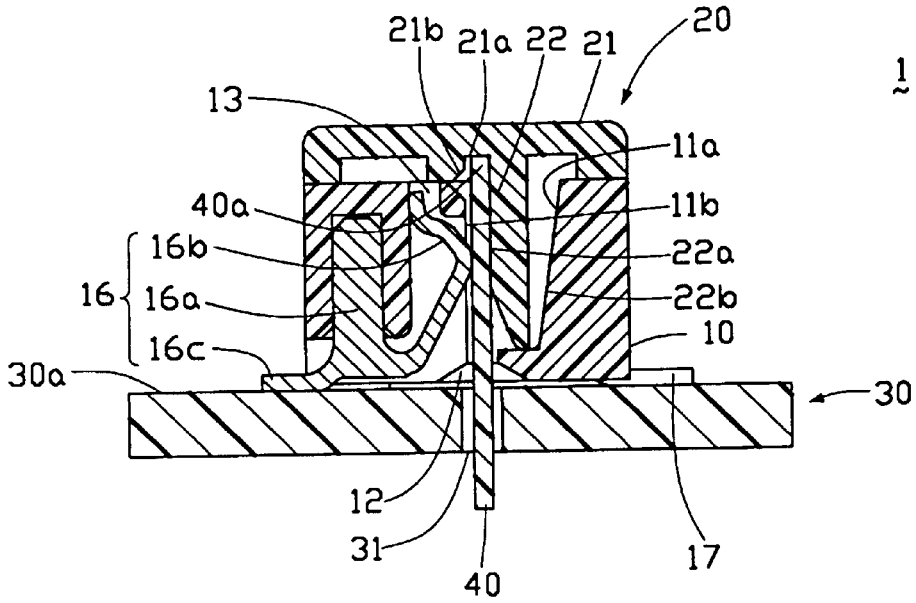
FIG. 9 is a cross sectional view with the inserted FFC cable reaching to a final position.

Referring to FIGS. 8 and 9, the FFC connector 1 in according to the present invention is assembled to a frame or a printed circuit board 30 having a slit 31 therein. The entrance 12 of the FFC connector 1 is right above the slit 31 for entrance of the FFC cable 40. In assembly, the FFC cable 40 is firstly inserted till a tip portion 40*a* thereof received in the retaining slot 21*a* of the cover 21. When the actuator 20 is located at the first position, the tongue 22 does not fully extend into the elongate slot 11 thereby providing a comparable large opening for insertion of the FFC cable 40. When the FFC cable 40 is retained in the retaining slot 21*a*, the actuator 20 starts moving downward thereby narrowing the elongate slot 11 as the tongue 22 extends therein. The actuator 20 is then moved downward such that the inclined surface 22*b* of the tongue 22 slides over the second surface 11*b* of the elongate slot 11 thereby pushing the FFC cable 40 toward the spring arms 16*b* of the terminals 16. When the actuator 20 reaches to its final position, i.e. the retaining lugs 23 securely engages with the retaining wedges 14, the FFC cable 40 is electrically connected to the terminals 16 of the housing 10. In addition, during the downward movement of the actuator 20, the FFC cable 40 wipes over the spring arms 16*b* which provides reliable electrical connections.

In the previous application, the FFC connector 1 is assembled on an upper face 30*a* of a frame or a printed circuit board 30 and right above the slit 31. In a second application, the FFC connector 1 is assembled in an opening 132 of a frame or a printed circuit board 130.

Figure 12:
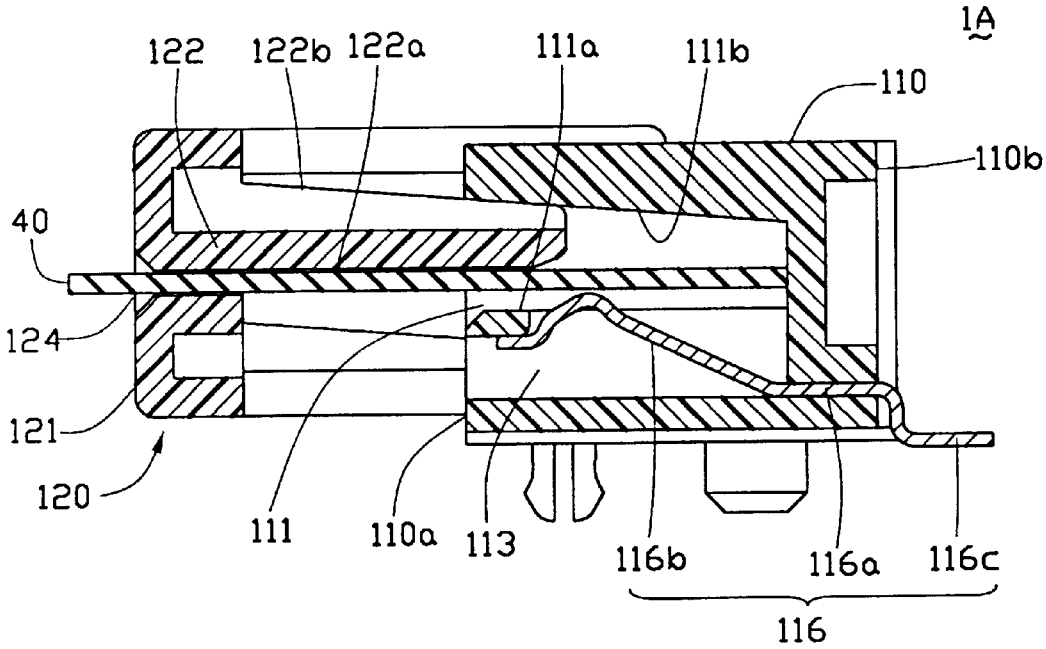
FIG. 12 is a cross sectional view of a FFC connector in accordance with a second embodiment of the present invention with an actuator in a first position.
Figure 13:
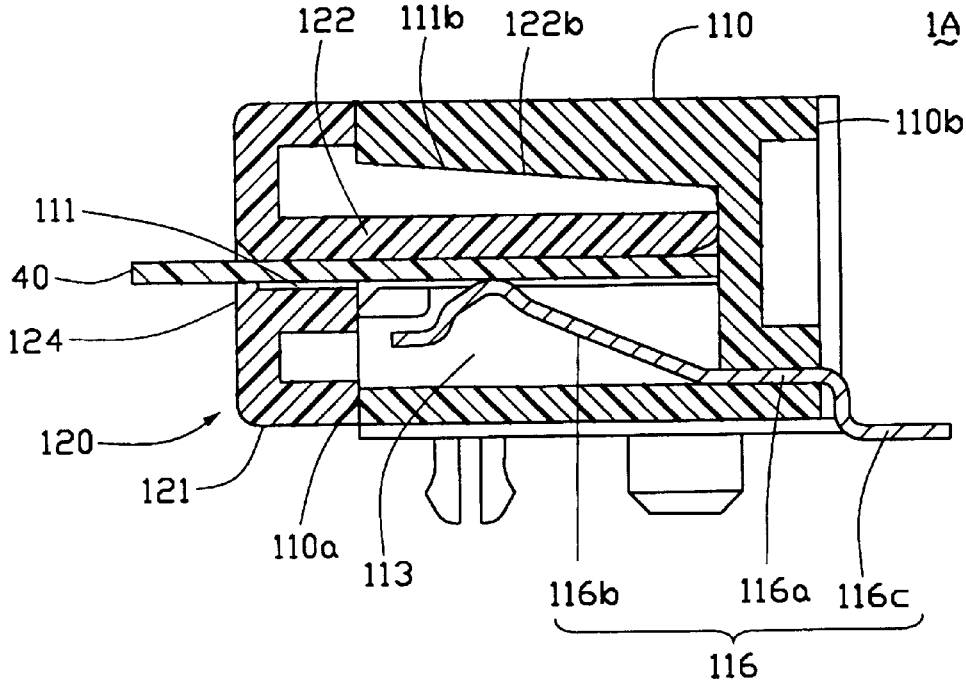
FIG. 13 is similar to FIG. 12 with the actuator in the second position.

Referring to FIGS. 12 and 13, an FFC connector 1A in accordance with the present invention comprises a dielectric housing 110 having front and rear faces 110*a*, 110*b*. The front face 110*a* forms an elongate slot 111 extending into the housing 110 for insertion of a FFC cable 40. A plurality of terminal cells 113 is defined in the housing 110 and each terminal cell 113 is in communication with the elongate slot 111. The elongate slot 111 has a first surface 111*a* for supporting the inserted FFC cable 40 and a second surface 111*b* inclined with respect to the first surface 111*a*.

A plurality of terminals 116 is assembled in the terminal cells 113. Each terminal 116 includes a base portion 116*a* received in the housing 110 and a spring arm 116*b* extending from the terminal cell 113 into the elongate slot 111. The terminal 116 further forms a soldering tail 116*c*.

An actuator 120 is assembled to the housing 110 for facilitating electrical connections between the inserted FFC cable 40 and the terminals 116. The actuator 120 includes a cover 121 assembled to the front face 110*a* of the housing 110 thereby sealing the elongate slot 111 of the housing 110. The cover 121 includes a tongue 122 extending into the elongate slot 111 for urging the FFC cable 40 against the first surface 111*a* of the elongate slot 111 in which the spring arms 116*b* extending therethrough. The cover 121 further defines a passage 124 for entrance of the FFC cable 40. By this arrangement, electrical connections between the inserted FFC cable 40 and the terminals 116 are achieved. The tongue 122 includes a flat surface 122*a* for pressing against the inserted FFC cable 40 and an inclined surface 122*b* with respect to the flat surface 111*b*.

When the actuator 120 is located at the first position, the tongue 122 does not fully extend into the elongate slot 111 thereby the FFC cable 140 can be easily inserted into the elongate slot 111. When the FFC cable 40 is positioned, the actuator 120 starts moving along a left direction thereby narrowing the elongate slot 111 as the tongue 122 extends therein. The actuator 120 is then moved further such that the inclined surface 122*b* of the tongue 122 slides over the second surface 111*b* of the elongate slot 111 thereby pushing the FFC cable 40 toward the spring arms 116*b* of the terminals 116. In addition, during the movement of the actuator 120, the FFC cable 40 wipes over the spring arms 116*b* which provides reliable electrical connections therebetween.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An FFC connector, comprising:

a dielectric housing having top and bottom faces, said top face defining an elongate slot extending into said housing and said bottom face defining an entrance in communication with said elongate slot for insertion of an FFC cable, a plurality of terminal cells defined in said housing and each being in communication with said elongate slot;

a plurality of terminals assembled in said terminal cells, each terminal including a base portion received in said housing and a spring arm extending from said terminal cell into said elongate slot, said terminal further forming a soldering tail for mounting to a printed circuit board; and an actuator assembled to said housing for facilitating electrical connections between an inserted FFC cable and said terminals, including a cover assembled to said top face of said housing thereby providing sealing effect thereto, wherein said cover includes a tongue extending into said elongate slot thereby facilitating electrical connections between said inserted FFC cable and said terminals and defines a retaining slot at a bottom face thereof for receiving said inserted FFC cable.

2. The FFC connector as recited in claim 1, wherein said elongate slot having a first surface for supporting said inserted FFC cable and a second surface inclined with respect to said first surface.

3. The FFC connector as recited in claim 1, wherein said tongue includes a flat surface for abutting against said inserted FFC cable and an inclined surface with respect to said flat surface.

4. The FFC connector as recited in claim 1, wherein said cover includes a pair of retaining lugs on opposite ends thereof for engaging with retaining wedges formed on said housing.

5. An FFC connector, comprising:

a dielectric housing having top and bottom faces, said top face defining an elongate slot extending into said housing, a plurality of terminal cells defined in said housing and each terminal cell being in communication with said elongate slot;

a plurality of terminals assembled in said terminal cells, each terminal including a base portion received in said housing and a spring arm extending from said terminal cell into said elongate slot, said terminal further forming a soldering tail for mounting to a printed circuit board; and an actuator assembled to said housing facilitating electrical connections between said terminals and an inserted FFC cable by vertical and horizontal movements, said actuator having a biasing face for urging said inserted FFC cable, wherein said biasing face and an inner wall of said elongate slot, in which said spring arms extend through, together define therebetween a first distance when said actuator is at a first position and a second distance, which is different to said first distance, when said actuator reaches a second position.

6. The FFC connector as recited in claim 5, wherein said first distance is larger than said second distance.

7. The FFC connector as recited in claim 5, wherein said actuator defines a passage for entrance of said FFC cable.

8. An electrical connector comprising:

a dielectric housing defining an elongated slot extending thereinto and a plurality of terminals projecting into said slot;

an actuator assembled to the housing; and means for facilitating guidable movement of the actuator in both perpendicular and horizontal directions with regards to the hosing so that when moved vertically with regard to the housing, said actuator is also moved horizontally to have an FFC, which is inserted into the slot, approach the terminals in both said two directions and obtain a smooth wiping action thereof, said means including a first inclined surface located beside and facing to said elongate slot, and a second inclined surface located on said actuator cooperating with and moveable along said first inclined surface for implementing said horizontal and vertical movements.

9. An electrical connection system comprising:

a substrate defining at least an opening therein;

a connector assembled to said substrate, said connector including a dielectric housing and an actuator assembled to said housing, said housing defining top and bottom faces oppositely and respectively forming an elongated slot and a bottom entrance;

a plurality of terminals disposed in the housing extending into the slot, respectively; and a tongue extending downwardly from said actuator into the slot, and facing to said terminals; wherein said slot and said bottom entrance are generally aligned with and communicates with each other in a vertical direction whereby an FFC is upwardly inserted from the bottom entrance into the slot and sandwiched between the terminals and the tongue.

10. The connection system as recited in claim 9, wherein a tip portion of said FFC initially extends above the top face of the housing, and successively moves downwardly along with the downwardly moved actuator to have said tip portion of the FFC generally received within the slot for engagement with the terminals due to abutment from the tongue of the actuator.

* * * * *